US011088478B2

(12) United States Patent
Ho et al.

(10) Patent No.: US 11,088,478 B2
(45) Date of Patent: Aug. 10, 2021

(54) ELECTRICAL CONNECTOR

(71) Applicant: LOTES CO., LTD, Keelung (TW)

(72) Inventors: Chien Chih Ho, Keelung (TW); Zuo Feng Jin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/999,261

(22) Filed: Aug. 21, 2020

(65) Prior Publication Data

US 2021/0066831 A1 Mar. 4, 2021

(30) Foreign Application Priority Data

Sep. 4, 2019 (CN) ..... 201910830797.0

(51) Int. Cl.

| | |
|---|---|
| ***H01R 12/00*** | (2006.01) |
| ***H01R 12/71*** | (2011.01) |
| ***H01R 4/02*** | (2006.01) |
| ***H01R 13/24*** | (2006.01) |
| ***H01R 13/6461*** | (2011.01) |
| ***H01R 13/6588*** | (2011.01) |

(52) U.S. Cl.

CPC ..... *H01R 12/714* (2013.01); *H01R 4/02* (2013.01); *H01R 13/2414* (2013.01); *H01R 13/6461* (2013.01); *H01R 13/6588* (2013.01)

(58) Field of Classification Search

CPC ..... H01R 23/722; H01R 13/2414; H01R 13/2421

USPC ..... 439/66, 91, 591, 700

See application file for complete search history.

(56) References Cited

U.S. PATENT DOCUMENTS

| | | | | |
|---|---|---|---|---|
| 7,404,721 | B2 * | 7/2008 | Ju | H05K 7/1061 439/135 |
| 7,473,104 | B1 | 1/2009 | Wertz | |
| 8,708,716 | B1 * | 4/2014 | Ho | H01R 43/02 439/83 |
| 10,116,079 | B1 | 10/2018 | Ju et al. | |
| 10,547,136 | B2 * | 1/2020 | Ho | H01R 13/2492 |

(Continued)

FOREIGN PATENT DOCUMENTS

| | | |
|---|---|---|
| CN | 2697861 Y | 5/2005 |
| CN | 101803116 A | 8/2010 |

(Continued)

*Primary Examiner* — Phuong Chi Thi Nguyen

(74) *Attorney, Agent, or Firm* — Locke Lord LLP; Tim Tingkang Xia, Esq.

(57) ABSTRACT

An electrical connector includes a body having an accommodating hole running vertically therethrough, and a conductive terminal accommodated in the accommodating hole. The conductive terminal includes: an upper terminal, having an upper base and an upper elastic arm formed by extending from the upper base; an upper connecting member, fixed on the upper base in a front-rear direction to be connected to a first strip; a lower terminal, electrically connected with the upper terminal and having a lower base and a lower elastic arm extending from the lower base; and a lower connecting member, fixed on the lower base in the front-rear direction to be connected to a second strip. The upper terminal, the lower terminal, the upper connecting member and the lower connecting member are formed separately. The upper extending portion and the lower extending portion are provided side by side and jointly positioned in the accommodating hole.

20 Claims, 11 Drawing Sheets

(56) References Cited

U.S. PATENT DOCUMENTS

| | | | | |
|---|---|---|---|---|
| 10,559,901 | B2 * | 2/2020 | Ju | H01L 23/3114 |
| 10,651,577 | B2 * | 5/2020 | Ho | H01R 12/7076 |
| 10,707,606 | B2 * | 7/2020 | Ho | H01R 12/57 |
| 2010/0330822 | A1 | 12/2010 | Lin et al. | |
| 2020/0227855 | A1 * | 7/2020 | Ho | H01R 43/205 |
| 2020/0313321 | A1 * | 10/2020 | Ho | H01R 12/714 |
| 2020/0313333 | A1 * | 10/2020 | Ho | H01R 12/58 |
| 2021/0175656 | A1 * | 6/2021 | Ho | H01R 13/2485 |

FOREIGN PATENT DOCUMENTS

| | | | |
|---|---|---|---|
| CN | 202503136 | U | 10/2012 |
| CN | 204088669 | U | 1/2015 |
| CN | 110071386 | A | 7/2019 |

* cited by examiner

B–B

2

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201910830797.0 filed in China on Sep. 4, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector with conductive terminals capable of being compressed in two directions.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In a conventional electrical connector for supporting a chip module, a conductive terminal has one elastic arm extending out above a plastic body of the electrical connector to be in contact with the chip module, and another elastic arm extending out below the plastic body of the electrical connector. The conductive terminal is provided with a strip connecting portion on at least one side of each elastic arm to be connected to a strip. For convenience of production and assembling, the entire conductive terminal and the strip for carrying the terminal are both formed by stamping a same plate material. After the conductive terminal is assembled to the plastic body through the strip, the conductive terminal is separated from the strip. However, in this conventional production technology, it is required to reserve a certain space on the conductive terminal to be connected to the strip, which is unfavorable for reducing the volume of the conductive terminal. Meanwhile, the conductive terminal has the excessive strip connecting portion to be connected to the strip. Further, it is required to provide a relatively large accommodating hole on the plastic body to correspondingly accommodate the conductive terminal, which is finally unfavorable for reducing the volume of the entire electrical connector, and does not satisfy the technical trend for minimization of electronic elements.

Therefore, a heretofore unaddressed need to design an improved electrical connector exists in the art to address the aforementioned deficiencies and inadequacies.

SUMMARY

The present invention is directed to an electrical connector having conductive terminals formed by upper and lower separated portions being staggered and extending.

To achieve the foregoing objective, the present invention adopts the following technical solutions.

An electrical connector includes: a body, having an accommodating hole running vertically therethrough; and a conductive terminal, accommodated in the accommodating hole, and comprising: an upper terminal, having an upper base and an upper elastic arm formed by extending from the upper base, wherein the upper elastic arm has an upper contact portion configured to be connected to a first electronic component; a lower terminal, electrically connected with the upper terminal and comprising a lower base and a lower elastic arm extending from the lower base, wherein the lower elastic arm has a lower contact portion configured to be connected to a second electronic component; an upper connecting member, fixed on the upper base in a front-rear direction to be connected to a first strip, wherein the upper connecting member has an upper extending portion extending downward to the lower terminal; and a lower connecting member, fixed on the lower base in the front-rear direction to be connected to a second strip, wherein the lower connecting member has a lower extending portion extending upward to the upper terminal, wherein the upper terminal, the lower terminal, the upper connecting member and the lower connecting member are formed separately, and the lower extending portion and the upper extending portion are provided side by side in a left-right direction and jointly positioned in the accommodating hole.

In certain embodiments, the upper connecting member and the lower connecting member surroundingly form a first through hole, and the upper extending portion and the lower extending portion are located at a left side and a right side of the first through hole.

In certain embodiments, the upper base and the lower base are in contact with each other and surroundingly form a second through hole, and the second through hole is in communication with the first through hole in the front-rear direction.

In certain embodiments, an area of the first through hole is greater than an area of the second through hole.

In certain embodiments, the upper base has two upper branches located at two sides of the second through hole, one of the two upper branches fixes the upper extending portion, and the other of the two upper branches is in contact with the lower extending portion; and the lower base has two lower branches located at two sides of the second through hole, one of the two lower branches fixes the lower extending portion, and the other of the two lower branches is in contact with the upper extending portion.

In certain embodiments, the two upper branches are correspondingly aligned and in contact with the two lower branches in a vertical direction.

In certain embodiments, the upper connecting member comprises an upper strip connecting portion to be connected to the first strip, the upper extending portion is formed by extending from one side below the upper strip connecting portion, the upper extending portion comprises a first section, a second section and a third section sequentially downward from top thereof, and the second section protrudes toward a direction away from the lower extending portion in the left-right direction relative to the first section and the third section; and the lower connecting member comprises a lower strip connecting portion to be connected to the second strip, the lower extending portion is formed by extending from one side above the lower strip connecting portion, the lower extending portion comprises a fourth section, a fifth section and a sixth section sequentially upward from bottom thereof, and the fifth section protrudes toward a direction away from the upper extending portion in the left-right direction relative to the fourth section and the sixth section.

In certain embodiments, the third section is in contact with the lower strip connecting portion and the fourth section, and the sixth section is in contact with the upper strip connecting portion and the first section.

In certain embodiments, in the left-right direction, a width of the upper strip connecting portion is equal to a sum of a width of the sixth section and a width of the first section, and a width of the lower strip connecting portion is equal to a sum of a width of the third section and a width of the fourth section.

In certain embodiments, a wall of the accommodating hole is plated with a conductive member thereon, and the conductive member is in contact with the upper extending portion and the lower extending portion.

In certain embodiments, the conductive member is in contact with the upper base and the lower base.

An electrical connector includes: a body, having an accommodating hole running vertically therethrough; and a conductive terminal, accommodated in the accommodating hole, and comprising: an upper terminal, having an upper base and an upper elastic arm formed by extending from the upper base, wherein the upper elastic arm has an upper contact portion configured to be connected to a first electronic component; an upper connecting member, fixed on the upper base in a front-rear direction to be connected to a first strip; a lower terminal, electrically connected with the upper terminal and comprising a lower base and a lower elastic arm extending from the lower base, wherein the lower elastic arm has a lower contact portion configured to be connected to a second electronic component; and a lower connecting member, fixed on the lower base in the front-rear direction to be connected to a second strip, wherein the upper terminal, the lower terminal, the upper connecting member and the lower connecting member are formed separately, the upper connecting member or the upper base has an upper extending portion extending downward, the lower connecting member or the lower base has a lower extending portion extending upward, and the upper extending portion and the lower extending portion are provided side by side and jointly positioned in the accommodating hole.

In certain embodiments, the upper connecting member and the lower connecting member surroundingly form a first through hole, the upper base and the lower base are in contact with each other and surroundingly form a second through hole, and the second through hole is in communication with the first through hole in the front-rear direction.

In certain embodiments, in a left-right direction, a maximum distance between outer side edges of the upper extending portion and the lower extending portion away from each other is greater than a width of a remaining portion of the conductive terminal.

In certain embodiments, the upper extending portion abuts the lower connecting member, and the lower extending portion abuts the upper connecting member.

In certain embodiments, the upper extending portion abuts the lower base in the front-rear direction, and the lower extending portion abuts the upper base in the front-rear direction.

In certain embodiments, a wall of the accommodating hole is plated with a conductive member thereon, and the conductive member is in contact with the upper extending portion and the lower extending portion.

In certain embodiments, the conductive member is in contact with the upper base and the lower base.

Compared with the related art, certain embodiments of the present invention have the following beneficial effects. The conventional conductive terminal occupies a relatively large space due to the need to provide the strip connecting portion integrally formed and extending. In comparison, in the present invention, the upper connecting member and the lower connecting member are formed separately to carry the upper terminal and the lower terminal. Since the upper connecting member being separately formed is fixed on the upper terminal in the front-rear direction, and the lower connecting member being separately formed is fixed on the lower terminal in the front-rear direction, the conductive terminal occupies a relatively small space. In a limited space of the same accommodating hole, The upper terminal and the lower terminal are provided side by side to form the upper extending portion and the lower extending portion reserved from each other, further increasing an insertion depth in the accommodating hole, preventing the upper terminal and the lower terminal from retreating from the accommodating hole, and ensuring a stable connection of the upper terminal and the lower terminal.

An electrical connector includes: a body, having an accommodating hole running vertically therethrough; an upper terminal, comprising an upper base and an upper elastic arm formed by extending from the upper base, wherein the upper elastic arm has an upper contact portion configured to be connected to a first electronic component, and the upper contact portion is located in front of the upper base; an upper connecting member, fixed on the upper base in a front-rear direction to be connected to a first strip, wherein the upper terminal and the upper connecting member are formed separately; a lower terminal, comprising a lower base and a lower elastic arm extending from the lower base, wherein the lower elastic arm has a lower contact portion configured to be connected to a second electronic component and the lower contact portion is located in front of the lower base; a lower connecting member, fixed on the lower base in the front-rear direction to be connected to a second strip, wherein the lower terminal and the lower connecting member are formed separately; and a conductive member, accommodated in the accommodating hole, wherein at least one of the upper terminal and the upper connecting member is in contact with the conductive member, and at least one of the lower terminal and the lower connecting member is in contact with the conductive member.

In certain embodiments, the upper contact portion and the lower contact portion are aligned vertically.

Compared with the related art, certain embodiments of the present invention have the following beneficial effects. The conventional conductive terminal occupies a relatively large space due to the need to provide the strip connecting portion integrally formed and extending. In comparison, in the present invention, the upper connecting member and the lower connecting member are formed separately to carry the upper terminal and the lower terminal. Since the upper connecting member being separately formed is fixed on the upper terminal in the front-rear direction, and the lower connecting member being separately formed is fixed on the lower terminal in the front-rear direction, the conductive terminal occupies a relatively small space. The conductive member is in contact with at least one of the upper terminal and the upper connecting member and at least one of the lower terminal and the lower connecting member, enhancing the electrical connection of the upper terminal and the lower terminal to a certain extent, and improving the electrical performance and the signal integrity of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
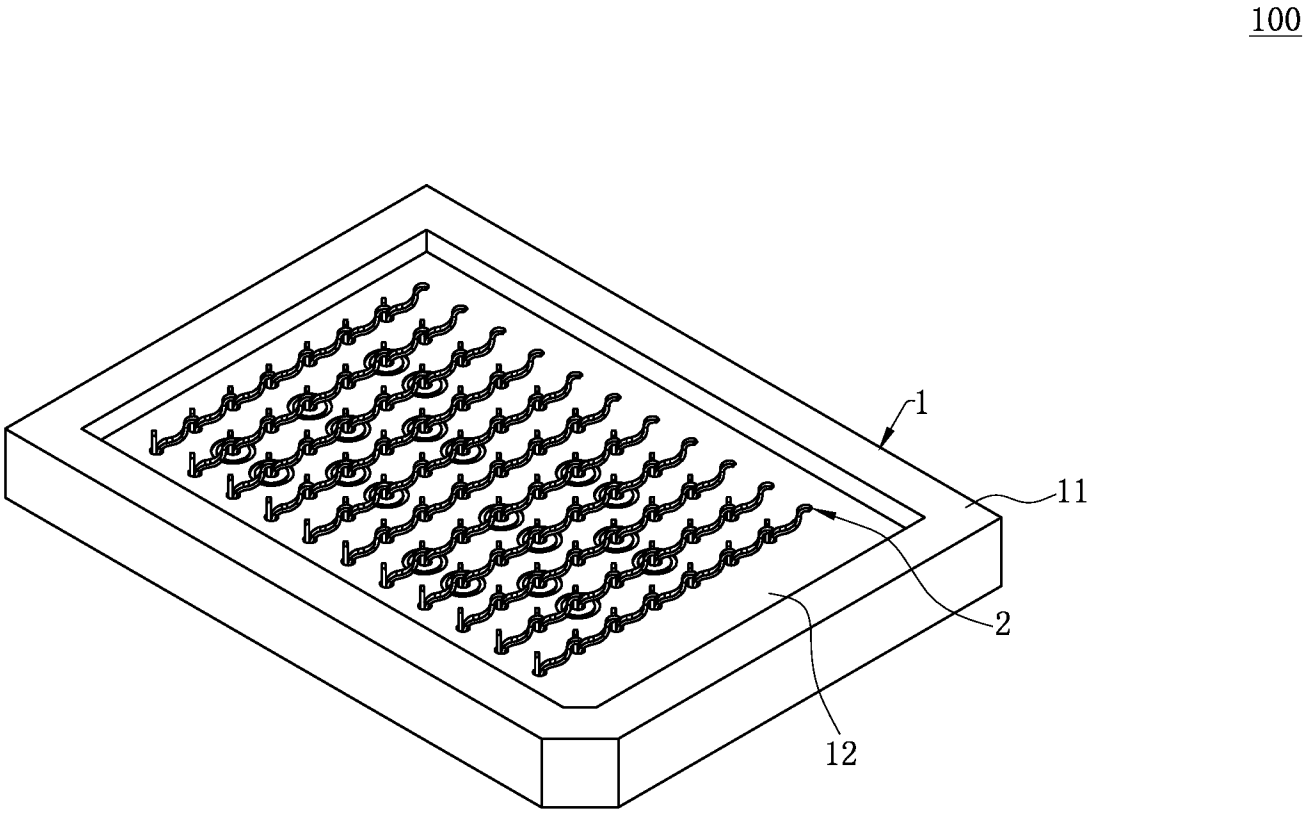
FIG. 1 is a perspective view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-11. In accordance with the purposes of this invention, as embodied and broadly described herein, this invention, in one aspect, relates to an electrical connector.

Figure 2:
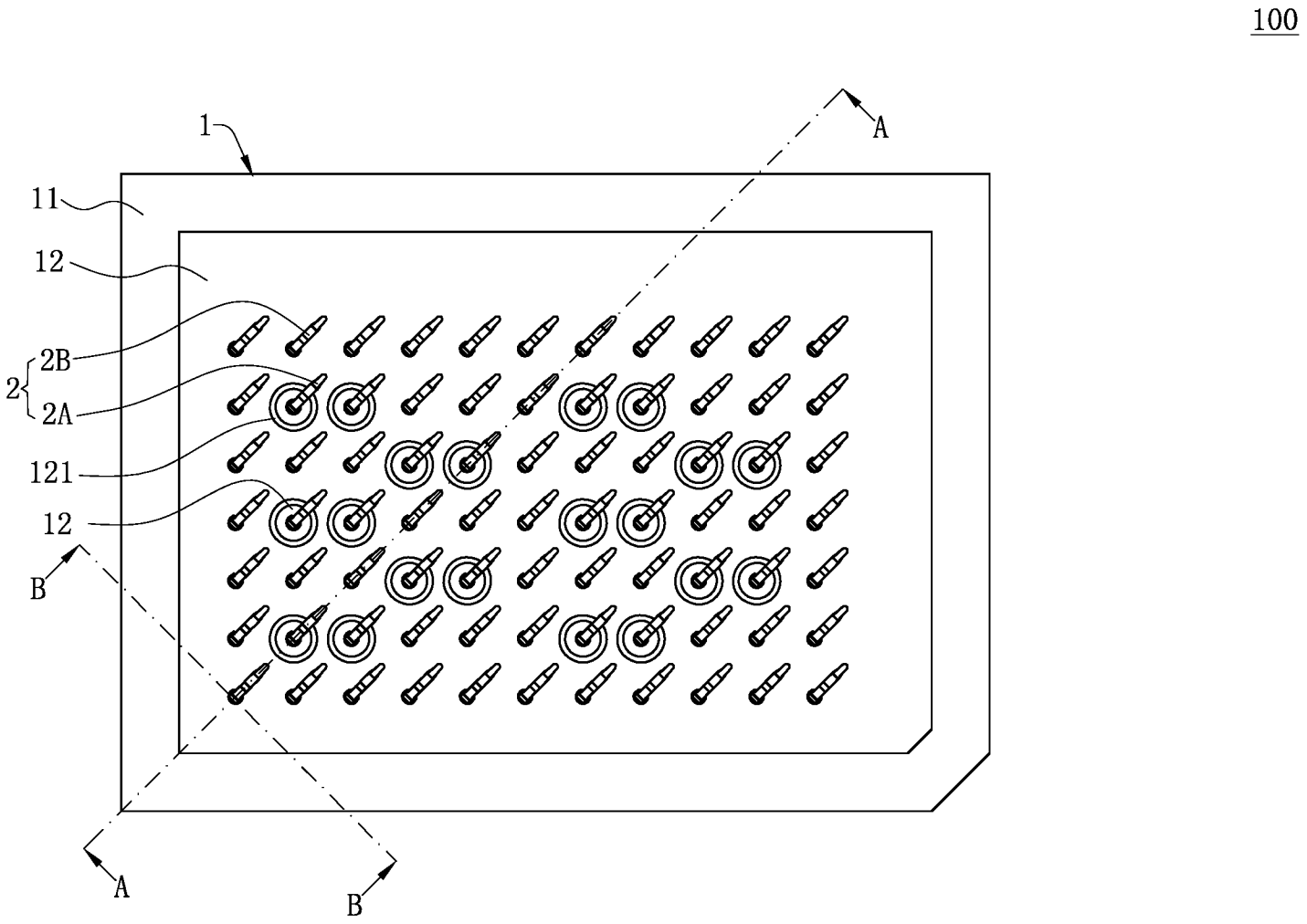
FIG. 2 is a top view of FIG. 1.
Figure 3:
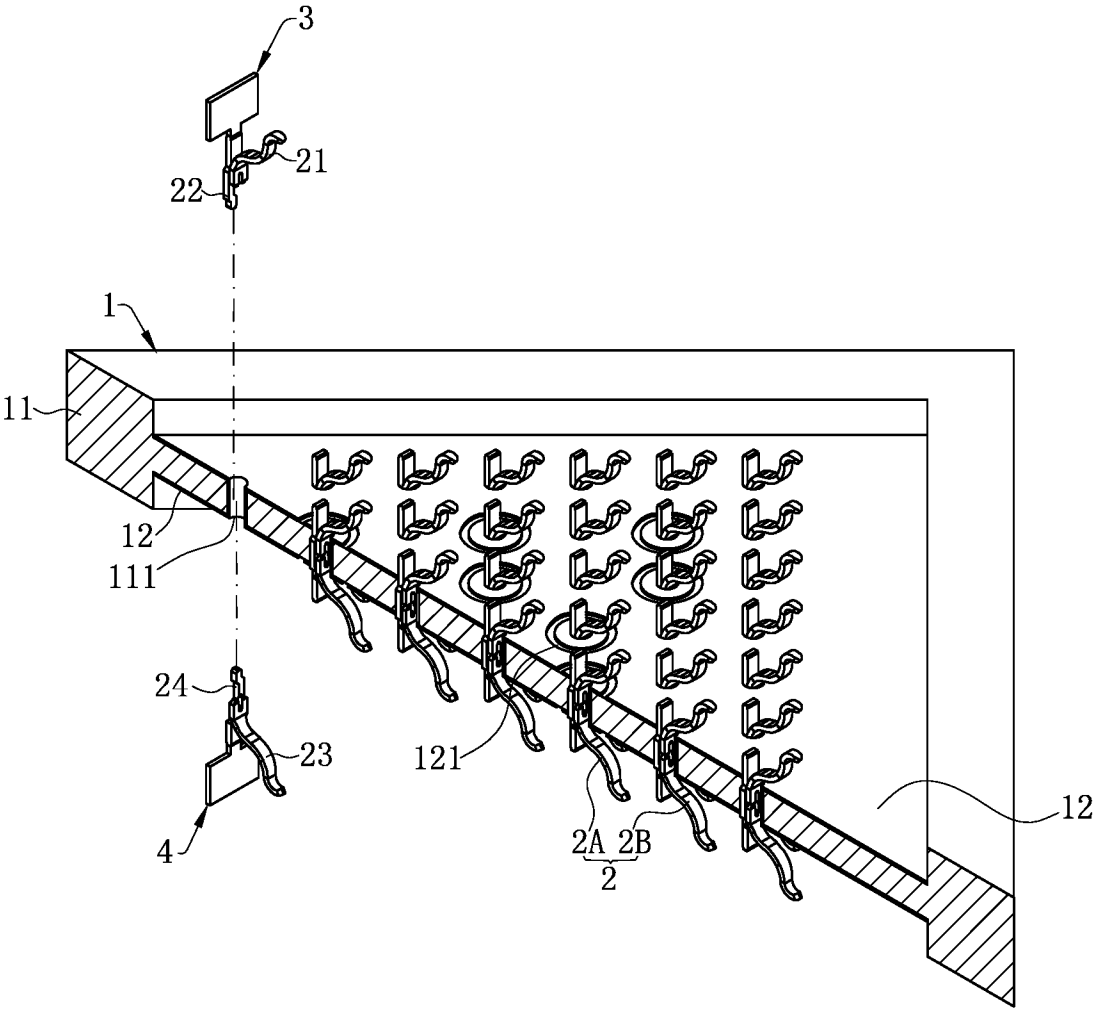
FIG. 3 is a schematic view of part of terminals in FIG. 1 before the terminals are assembled into a body.

FIG. 1 to FIG. 3 shows an electrical connector 100 according to a first embodiment of the present invention. The electrical connector 100 includes a body 1 and a plurality of conductive terminals 2 correspondingly accommodated in the body 1.

Figure 4:
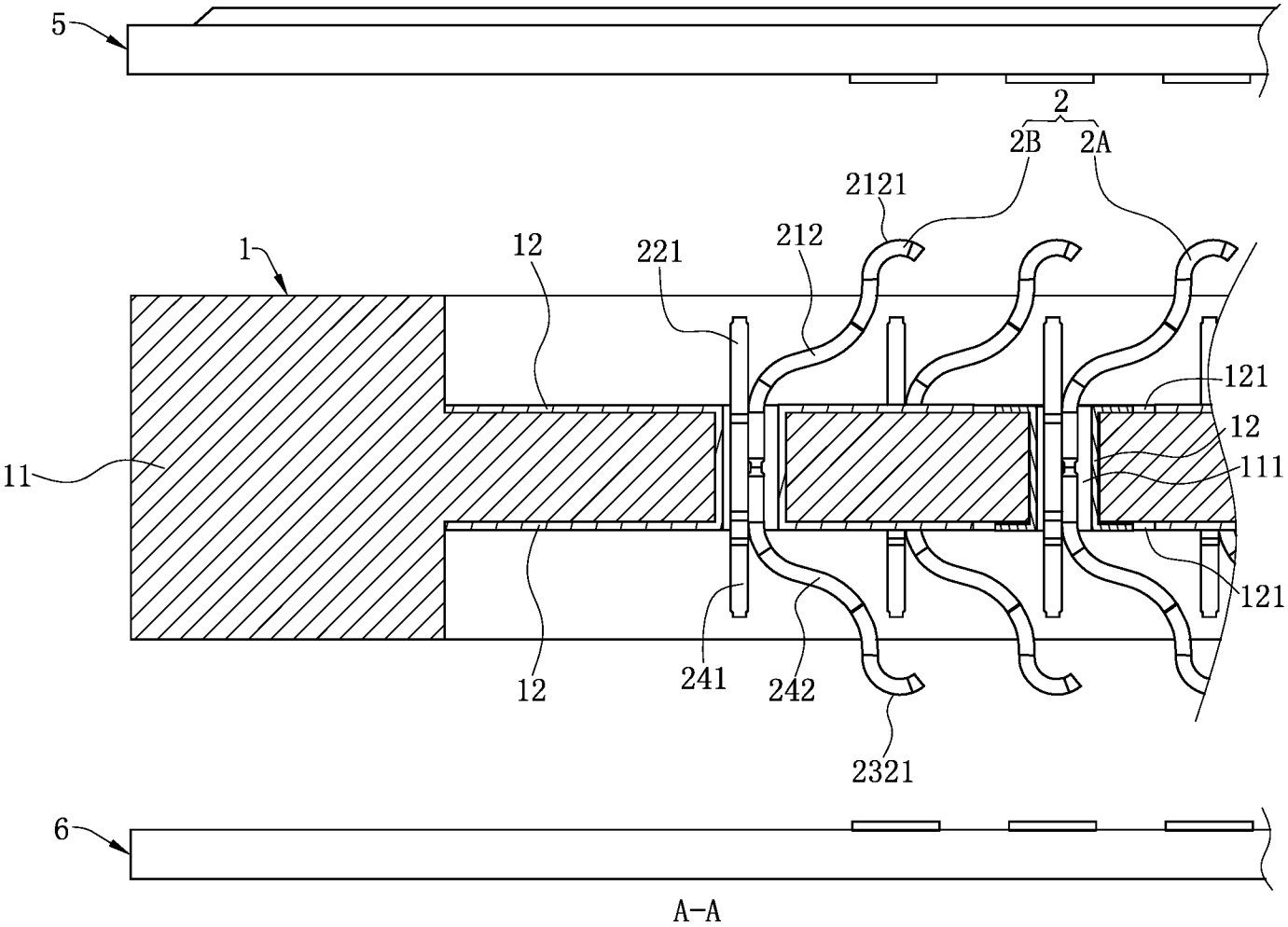
FIG. 4 is a partial sectional view of the electrical connector in FIG. 2 along a line A-A and a first electronic component and a second electronic component.
Figure 5:
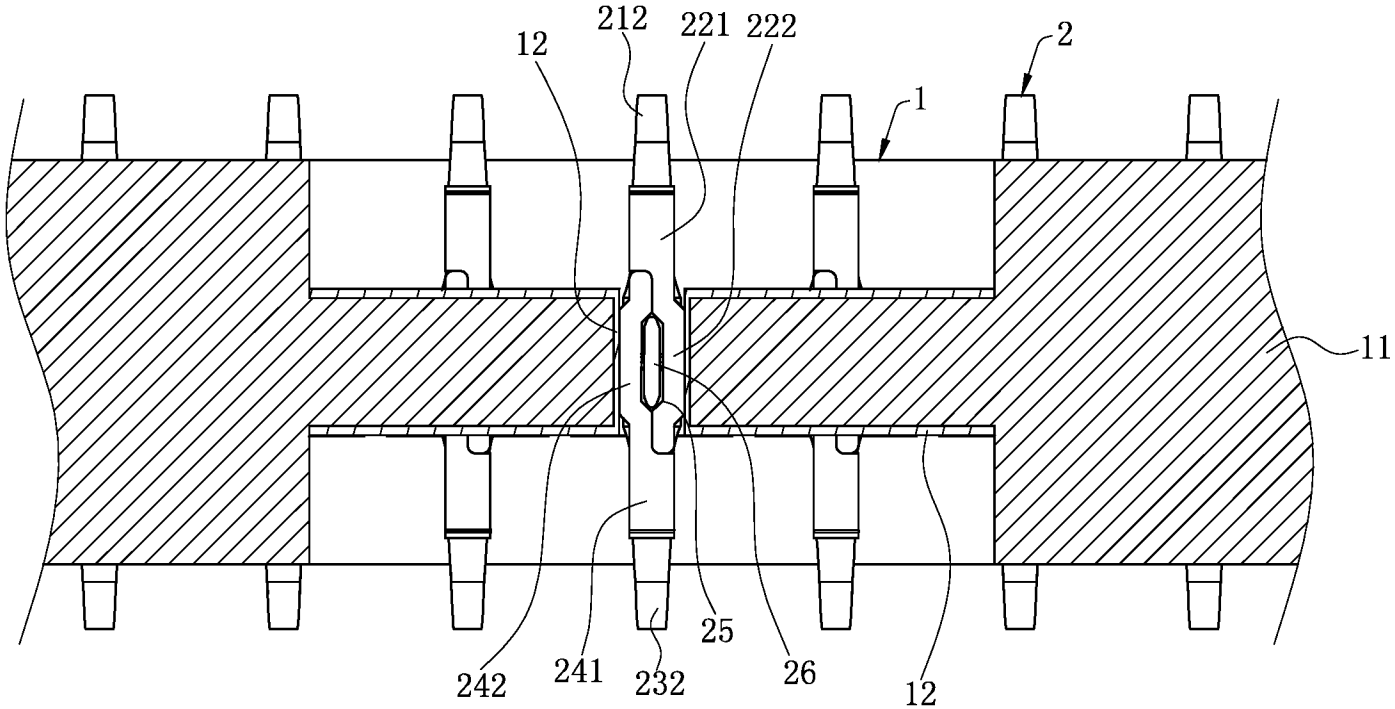
FIG. 5 is a partial sectional view of FIG. 2 along a line B-B.

As shown in FIG. 3 to FIG. 5, the body 1 includes an insulating member 11 made of an insulating material and a plurality of conductive members 12 plated on the surface of the insulating member 11. The insulating member 11 has a plurality of accommodating holes 111 running vertically therethrough to correspondingly accommodate the conductive terminals 2. Each of the conductive members 12 may be made of a metal material. The conductive members 12 are plated on the upper surface and the lower surface of the insulating member 11 and the walls of the accommodating holes 111. In the present embodiment, the conductive members 12 are mainly used as shielding layers. The conductive members 12 provided on the walls of the accommodating holes 111 are used to shield the electromagnetic interference between any two adjacent conductive terminals 2, and the conductive members 12 provided on the upper surface and the lower surface of the insulating member 11 are used to prevent the electromagnetic interference generated by the electrical connector 100 from leaking and affecting other electronic components.

As shown in FIG. 3 and FIG. 4, the conductive members 12 are not all integrally interconnected. The conductive terminals 2 includes a plurality of signal terminals 2A and a plurality of ground terminals 2B. The conductive members 12 corresponding to the ground terminals 2B are integrally connected with the conductive members 12 on the upper surface and the lower surface of the insulating member 11, so as to enlarge the area of ground shielding, and further enhance the shielding effect. The conductive members 12 corresponding to the signal terminals 2A are separated from the conductive members 12 forming the ground shielding, thereby forming a plurality of separating slots 121 on the upper surface and the lower surface of the insulating member 11, and preventing from short-circuiting between the signal terminals 2A and the ground terminals 2B.

Figure 6:
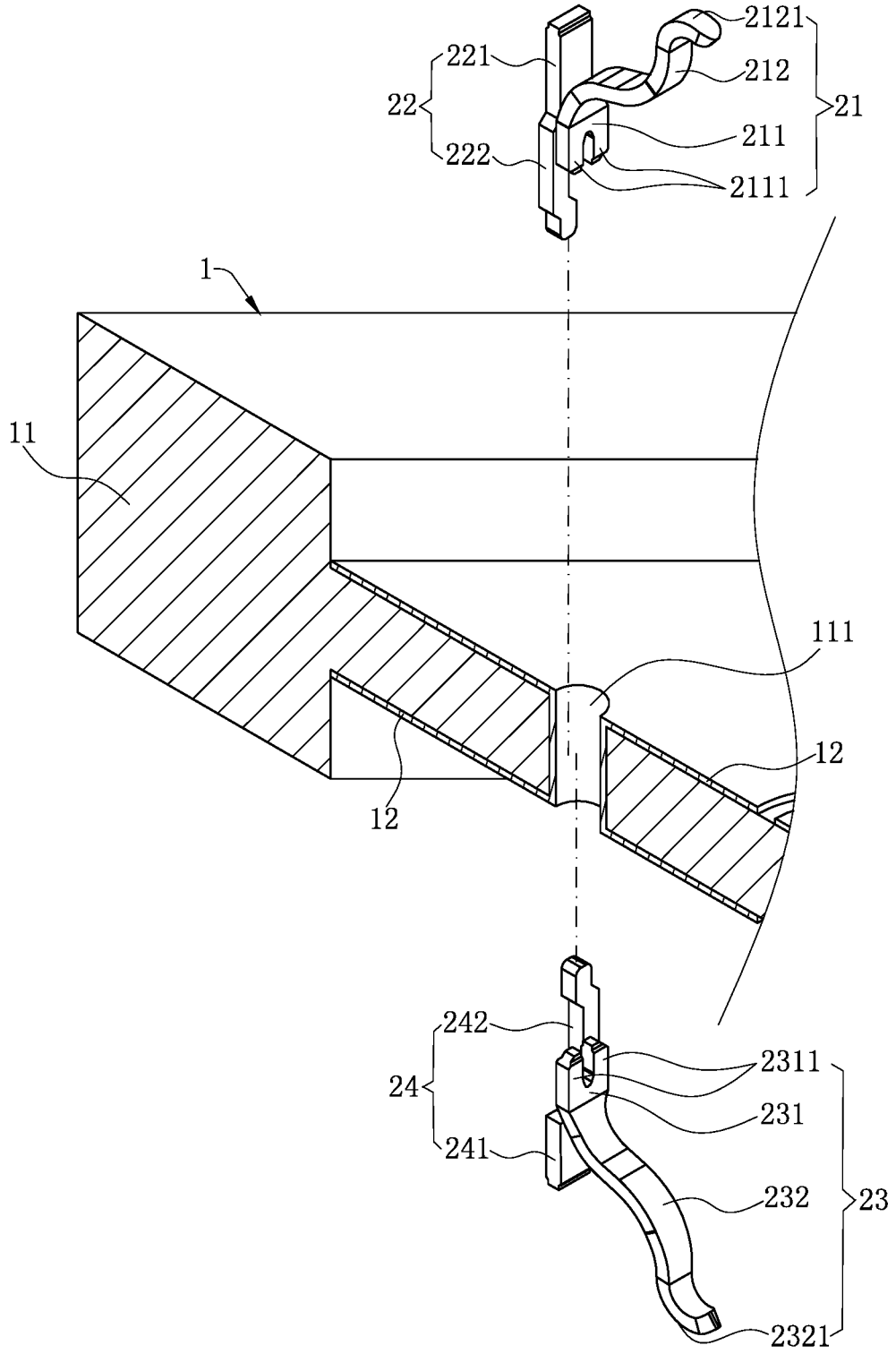
FIG. 6 is a partial enlarged view of FIG. 3 with the strips being removed.
Figure 9:
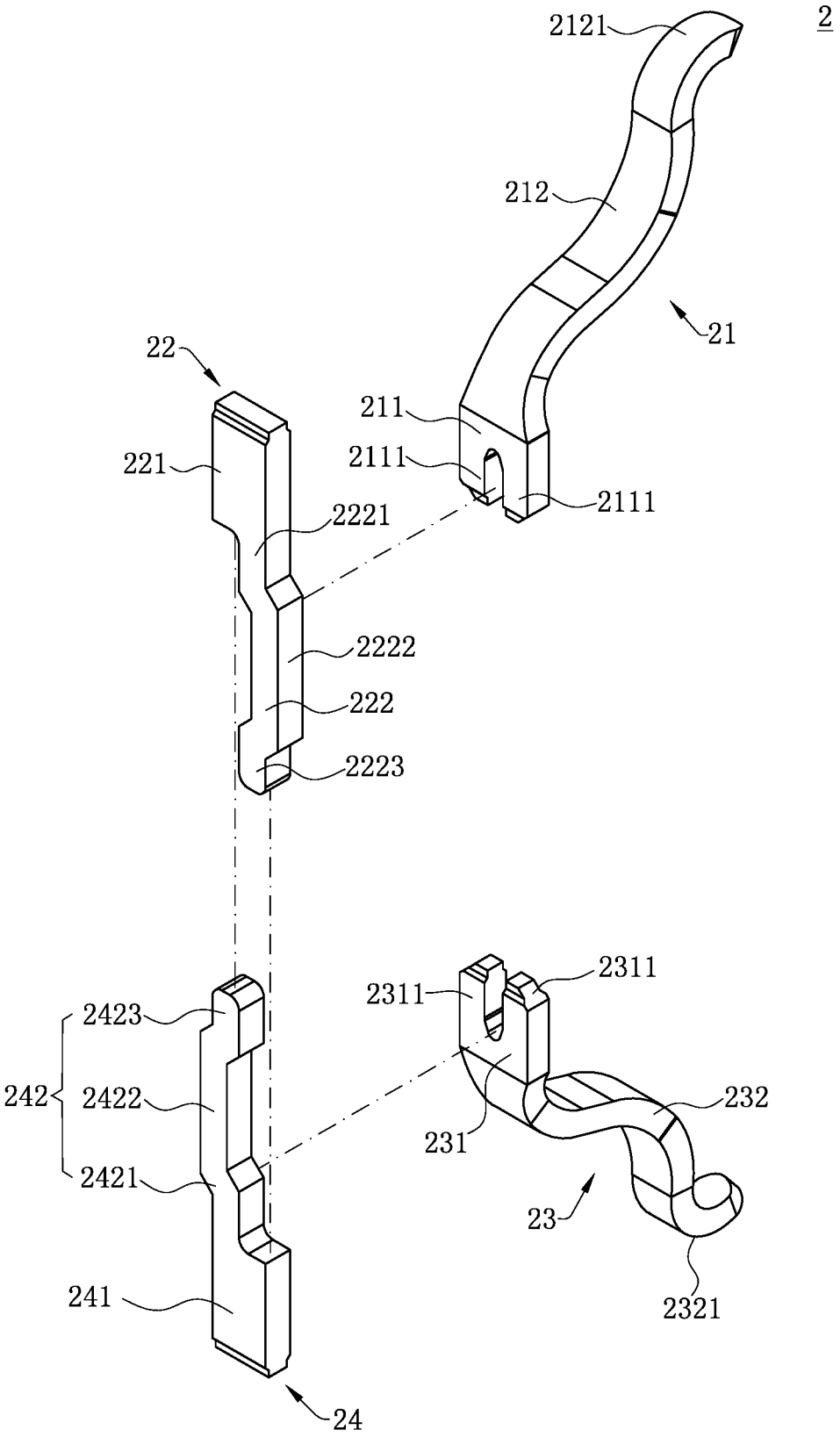
FIG. 9 is an exploded view of FIG. 8.

As shown in FIG. 6 and FIG. 9, each conductive terminal 2 includes an upper terminal 21, an upper connecting member 22, a lower terminal 23 and a lower connecting member 24 formed separately. The upper terminal 21 and the upper connecting member 22 are assembled to each accommodating hole 111 from a position above the body 1, so as to form an upper half portion of the conductive terminal 2. The lower terminal 23 and the lower connecting member 24 are assembled to each accommodating hole 111 from a position below the body 1, so as to form a lower half portion of the conductive terminal 2. The lower portion of the upper connecting member 22 and the upper portion of the lower connecting member 24 are provided side by side in a left-right direction.

Figure 7:
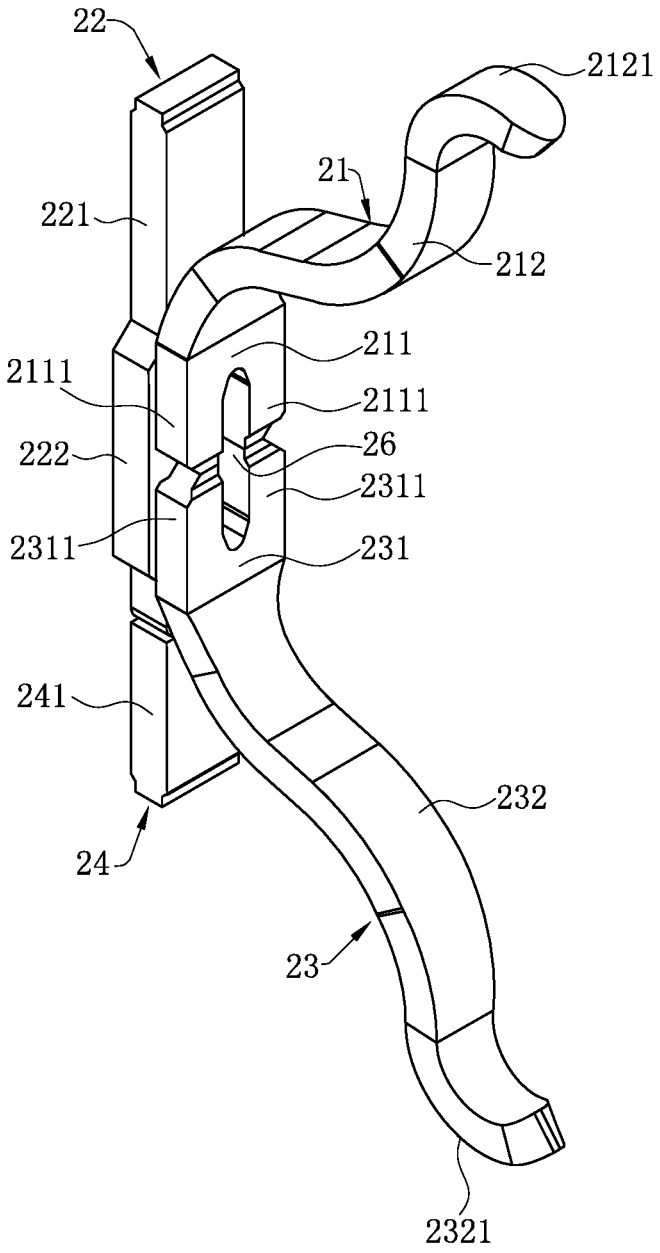
FIG. 7 is a perspective view of a conductive terminal in FIG. 3.
Figure 8:
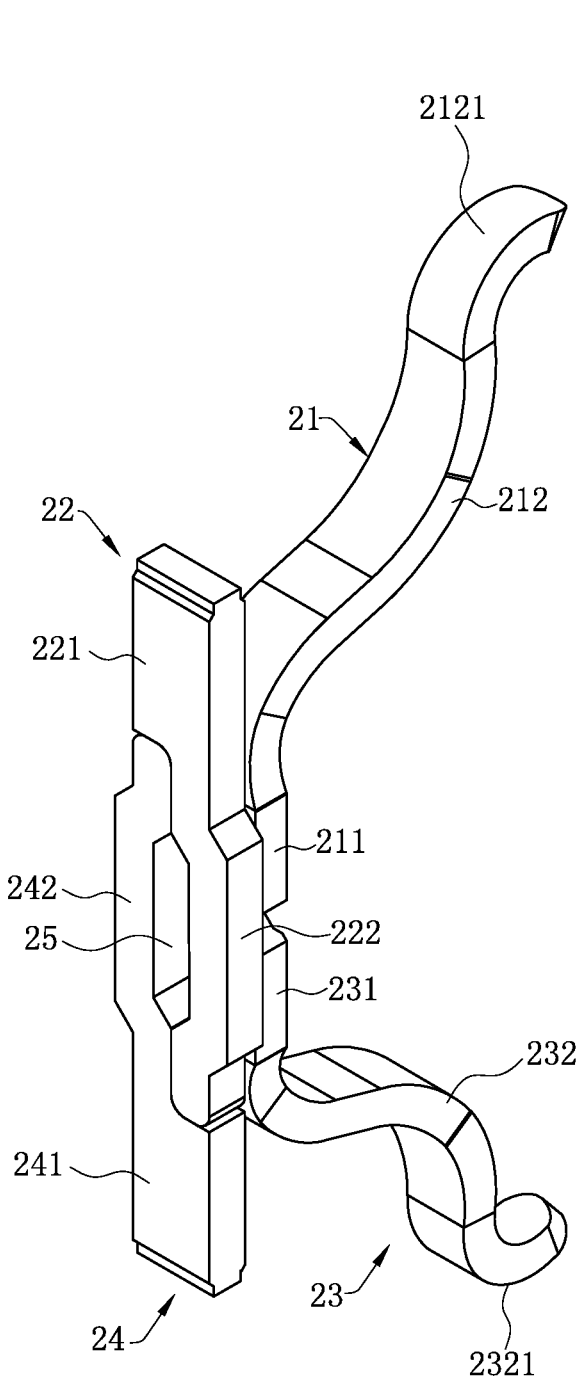
FIG. 8 is a perspective view of FIG. 7 being rotated 90 degrees counterclockwise.

As shown in FIG. 7 to FIG. 9, the upper terminal 21 has an upper base 211 and an upper elastic arm 212 formed by extending upward from the upper base 211. The upper base 211 and the upper connecting member 22 are fixed together through laser soldering, and the lower end of the upper base 211 has two upper branches 2111 extending downward and separated from each other. The upper elastic arm 212 has an upper contact portion 2121 located in front of the upper base 211 to be connected to a first electronic component 5 (also referring to FIG. 4). In the present embodiment, the first electronic component 5 is a chip module.

As shown in FIG. 7 to FIG. 9, the upper connecting member 22 is fixed behind the upper base 211, and includes an upper strip connecting portion 221 to be connected to a first strip 3 which is integrally formed (also referring to FIG. 3), and an upper extending portion 222 extending downward from one side below the upper strip connecting portion 221 to the lower terminal 23. The upper extending portion 222 is fixed on one of the upper branches 2111, and includes a first section 2221, a second section 2222 and a third section 2223 sequentially downward from top thereof. The second section 2222 protrudes toward a direction away from the lower connecting member 24 in a left-right direction relative to the first section 2221 and the third section 2223.

As shown in FIG. 7 to FIG. 9, the lower terminal 23 includes a lower base 231 and a lower elastic arm 232 extending downward from the lower base 231. The lower base 231 and the lower connecting member 24 are fixed together through laser soldering, and the upper end of the lower base 231 has two lower branches 2311 extending upward and separated from each other. The lower elastic arm 232 has a lower contact portion 2321 located in front of the lower base 231 to be connected to a second electronic component 6 (also referring to FIG. 4). The lower contact portion 2321 and the upper contact portion 2121 are aligned vertically. In the present embodiment, the second electronic component 6 is a circuit board.

As shown in FIG. 7 to FIG. 9, the lower connecting member 24 is fixed behind the lower base 231, and includes a lower strip connecting portion 241 to be connected to a second strip 4 which is integrally formed (also referring to FIG. 3), and a lower extending portion 242 extending upward from one side above the lower strip connecting portion 241 to the upper terminal 21. The lower extending portion 242 is fixed on one of the lower branches 2311. The lower extending portion 242 and the upper extending portion 222 are staggered from each other in the left-right direction and provided side by side. The lower extending portion 242 includes a fourth section 2421, a fifth section 2422 and a sixth section 2423 sequentially upward from bottom thereof. The fifth section 2422 protrudes toward a direction away from the second section 2222 in the left-right direction relative to the fourth section 2421 and the sixth section 2423.

As shown in FIG. 5 and FIG. 8, the upper terminal 21, the upper connecting member 22, the lower terminal 23 and the lower connecting member 24 form the whole conductive terminal 2. The upper connecting member 22 and the lower connecting member 24 surroundingly form a first through hole 25. The third section 2223 is in contact with the lower strip connecting portion 241 and the fourth section 2421. The sixth section 2423 is in contact with the upper strip connecting portion 221 and the first section 2221. The first through hole 25 is located between the upper extending portion 222 and the lower extending portion 242 in the left-right direction, and a maximum distance between the outer side edges of the upper extending portion 222 and the lower extending portion 242 away from each other, namely a distance between the outer side edges of the second section 2222 and the fifth section 2422, is greater than the width of the remaining portion of the conductive terminal 2, such that the second section 2222 and the fifth section 2422 squeeze the wall of the accommodating hole 111 to fix the whole conductive terminal 2. The first through hole 25 is used as a reserved space for deformation after the upper extending portion 222 and the lower extending portion 242 squeeze the wall of the accommodating hole 111, allowing the upper extending portion 222 and the lower extending portion 242 to simultaneously enter the accommodating hole 111 conveniently, and increasing a reactive force of the upper extending portion 222 and the lower extending portion 242 to the wall of the accommodating hole 111, thus enhancing the retaining effect.

As shown in FIG. 7 and FIG. 9, the upper base 211 and the lower base 231 are in contact and surroundingly form a second through hole 26. The second through hole 26 is located between the two upper branches 2111 and between the two lower branches 2311, respectively, and is in communication with the first through hole 25 in a front-rear direction. An area of the second through hole 26 is less than an area of the first through hole 25 (also referring to FIG. 5), so as to improve the elasticity of the portion of the conductive terminal 2 squeezing the wall of the accommodating hole 111 on the premise of ensuring the intensity of the upper terminal 21 and the lower terminal 23. In addition, in the left-right direction, a width of the upper strip connecting portion 221 is equal to a sum of a width of the sixth section 2423 and a width of the first section 2221, and a width of the lower strip connecting portion 241 is equal to a sum of a width of the third section 2223 and a width of the fourth section 2421.

As shown in FIG. 3, FIG. 5 and FIG. 6, the first strip 3 inserts the upper terminal 21 into a corresponding one of the accommodating holes 111 through the upper connecting member 22, and the second strip 4 inserts the corresponding lower terminal 23 into the same accommodating hole 111 through the lower connecting member 24. In the insertion process, the upper extending portion 222 and the lower extending portion 242 are reserved from each other due to left-right staggering. Finally, the upper extending portion 222 and the lower extending portion 242 are provided side by side in the left-right direction in the same accommodating hole 111, and abut the conductive member 12 on the wall of the accommodating hole 111, such that the upper terminal 21 and the lower terminal 23 are fixed in the same accommodating hole 111.

After the assembling is completed, each conductive member 12 is in contact with the upper extending portion 222 and the lower extending portion 242, and is further in contact with the upper base 211 and the lower base 231, thus enhancing the electrical connection of the upper terminal 21 and the lower terminal 23 to a certain extent, and improving the electrical performance and the signal integrity of the electrical connector 100.

Figure 10:
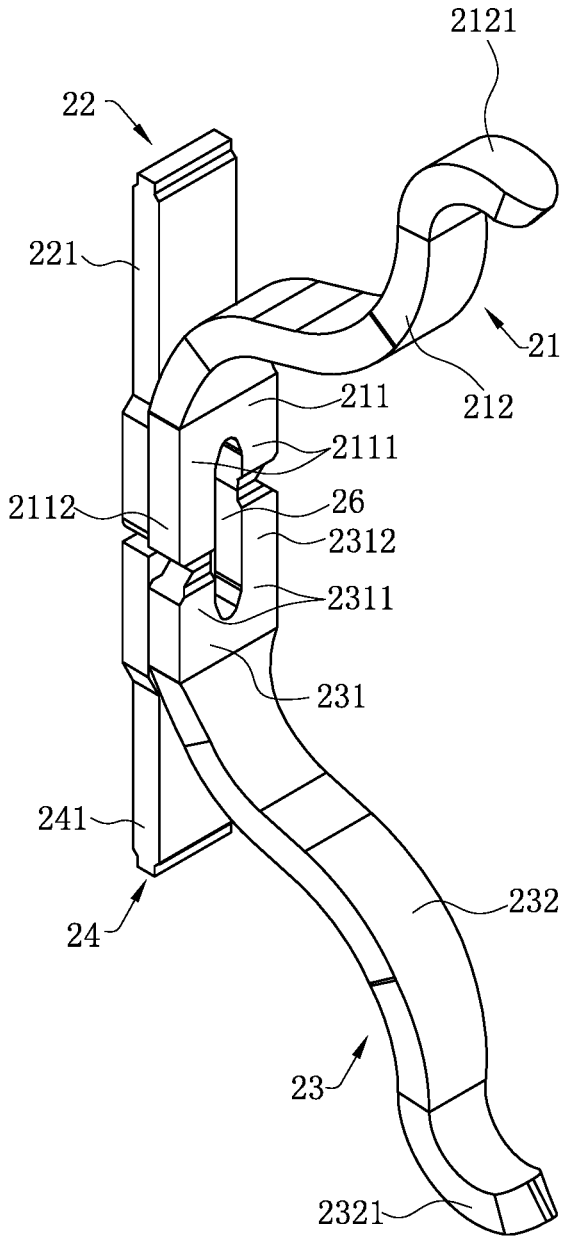
FIG. 10 is a perspective view of a conductive terminal of the electrical connector according to a second embodiment of the present invention.

FIG. 10 shows a conductive terminal 2 of an electrical connector according to a second embodiment of the present invention, which is different from the first embodiment in that: one of the upper branches 2111 extends downward to form an upper extending portion 2112, and one of the lower branches 2311 extends upward to form a lower extending portion 2312. The upper extending portion 2112 and the lower extending portion 2312 are correspondingly located at the left and right sides of the second through hole 26, and the width of the upper base 211 and the width of the lower base 231 are both greater than or equal to the maximum width of the upper connecting member 22 and the maximum width of the lower connecting member 24. In this case, the upper base 211 and the lower base 231 respectively abut the wall of the accommodating hole. That is, the upper base 211 and the lower base 231 are mainly used to fix the entire conductive terminal 2. Some of the specific structures of the upper connecting member 22 and the lower connecting member 24 are not shown in the drawings, and may be similar to the upper base 211 and the lower base 231 in the first embodiment. That is, two sides below the upper strip connecting portion 221 simultaneously extend downward to form two branches in equal lengths, and two sides above the lower strip connecting portion 241 simultaneously extend upward to form two branches in equal lengths. Further, the upper connecting member 22 and the lower connecting member 24 are surrounded by the four branches to form the first through hole.

Figure 11:
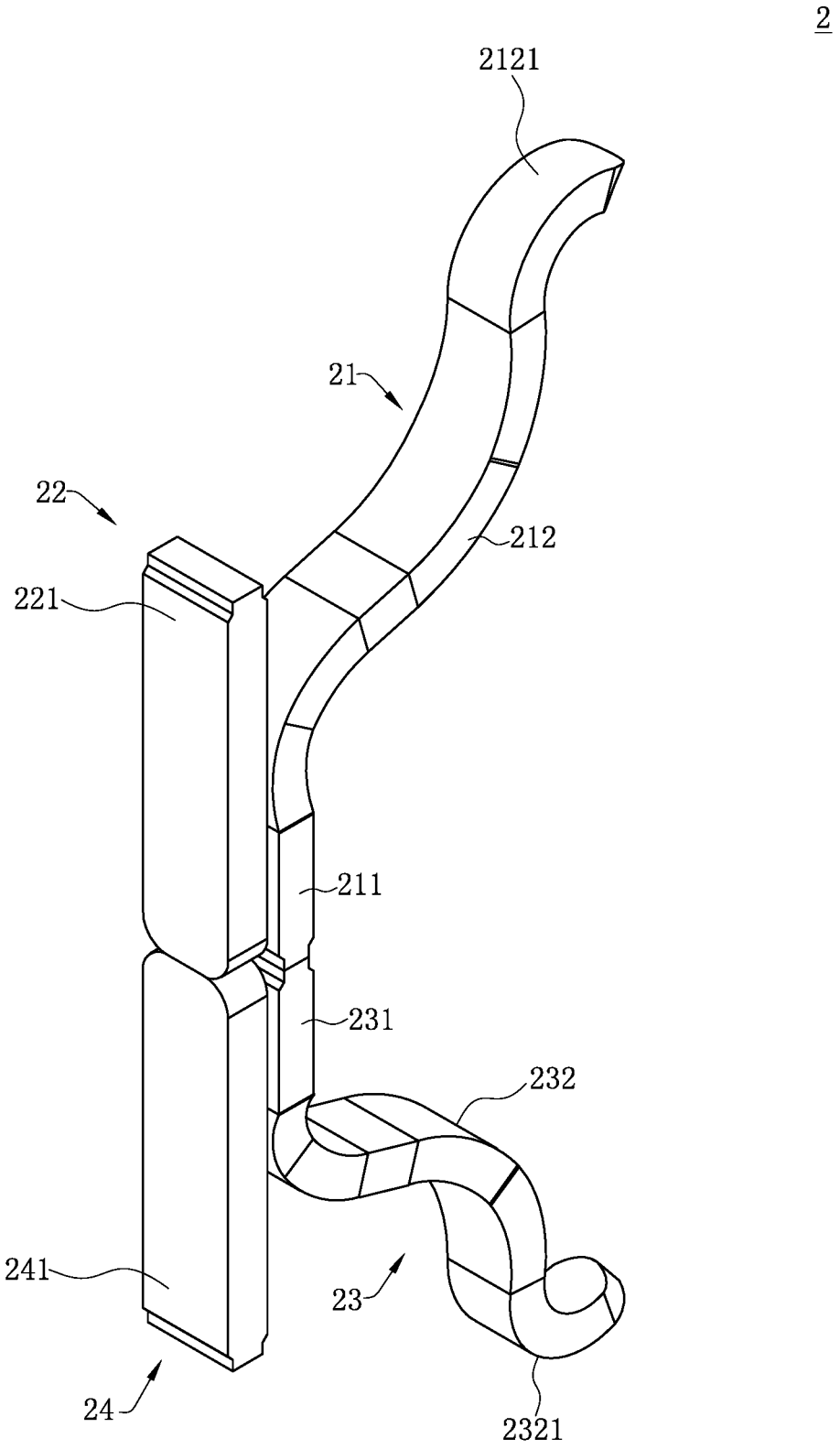
FIG. 11 is a perspective view of a conductive terminal of the electrical connector according to a third embodiment of the present invention.

FIG. 11 shows a conductive terminal 2 of an electrical connector according to a third embodiment of the present invention, which is different from the first embodiment in that: the conductive terminal 2 does not have the upper extending portion and the lower extending portion staggered from each other and provided side by side in the left-right direction, the first through hole, and the second through hole. The entire upper connecting member 22 is formed directly by extending downward from an upper strip connecting portion 221, and the entire lower connecting member 24 is formed directly by extending upward from a lower strip connecting portion 241. The width of the upper base 211 in the left-right direction is greater than the width of the upper strip connecting portion 221 in the left-right direction, and the width of the lower base 231 in the left-right direction is greater than the width of the lower strip connecting portion 241 in the left-right direction. In this case, the upper base 211 and the lower base 231 mainly interfere with the conductive member.

To sum up, the electrical connector 100 according to certain embodiments of the present invention has the following beneficial effects:

1) The conventional conductive terminal occupies a relatively large space due to the need to provide the strip connecting portion integrally formed and extending. In comparison, in the present invention, the upper connecting member 22 and the lower connecting member 24 are formed separately to carry the upper terminal 21 and the lower terminal 23. Since the upper connecting member 22 being separately formed is fixed on the upper terminal 21 in the front-rear direction, and the lower connecting member 24 being separately formed is fixed on the lower terminal 23 in the front-rear direction, the conductive terminal 2 occupies a relatively small space. In a limited space of the same accommodating hole 111, the upper terminal 21 and the lower terminal 23 are provided side by side to form the upper extending portion 222 and the lower extending portion 242 reserved from each other, further increasing an insertion depth in the accommodating hole 111, preventing the upper terminal 21 and the lower terminal 23 from retreating from the accommodating hole 111, and ensuring a stable connection of the upper terminal 21 and the lower terminal 23.

2) The upper connecting member 22 and the lower connecting member 24 surroundingly form a first through hole 25. The first through hole 25 is located between the upper extending portion 222 and the lower extending portion 242 in the left-right direction. The first through hole 25 is used as a reserved space for deformation after the upper extending portion 222 and the lower extending portion 242 squeeze the wall of the accommodating hole 111, allowing the upper extending portion 222 and the lower extending portion 242 to simultaneously enter the accommodating hole 111 conveniently, and increasing a reactive force of the upper extending portion 222 and the lower extending portion 242 to the wall of the accommodating hole 111, thus enhancing the retaining effect.

3) The upper base 211 and the lower base 231 are in contact and surroundingly form a second through hole 26. The second through hole 26 is located between the two upper branches 2111 and between the two lower branches 2311, respectively, and is in communication with the first through hole 25 in a front-rear direction, so as to improve the elasticity of the portion of the conductive terminal 2 squeezing the wall of the accommodating hole 111 on the premise of ensuring the intensity of the upper terminal 21 and the lower terminal 23.

4) The conductive members 12 plated on the walls of the accommodating holes 111 are used to shield the electromagnetic interference between any two adjacent conductive terminals 2, and are in contact with the upper extending portion 222 and the lower extending portion 242 and further in contact with the upper base 211 and the lower base 231, thus enhancing the electrical connection of the upper terminal 21 and the lower terminal 23 to a certain extent, and improving the electrical performance and the signal integrity of the electrical connector 100.

5) The third section 2223 is in contact with the lower strip connecting portion 241 and the fourth section 2421, and the sixth section 2423 is in contact with the upper strip connecting portion 221 and the first section 2221, such that the upper connecting member 22 and the lower connecting member 24 may limit the positions of each other simultaneously in the vertical direction and the left-right direction to keep a close fit therebetween.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

a body, having an accommodating hole running vertically therethrough; and a conductive terminal, accommodated in the accommodating hole, and comprising:

an upper terminal, having an upper base and an upper elastic arm formed by extending from the upper base, wherein the upper elastic arm has an upper contact portion configured to be connected to a first electronic component;

a lower terminal, electrically connected with the upper terminal and comprising a lower base and a lower elastic arm extending from the lower base, wherein the lower elastic arm has a lower contact portion configured to be connected to a second electronic component;

an upper connecting member, fixed on the upper base in a front-rear direction to be connected to a first strip, wherein the upper connecting member has an upper extending portion extending downward to the lower terminal; and a lower connecting member, fixed on the lower base in the front-rear direction to be connected to a second strip, wherein the lower connecting member has a lower extending portion extending upward to the upper terminal, wherein the upper terminal, the lower terminal, the upper connecting member and the lower connecting member are formed separately, and the lower extending portion and the upper extending portion are provided side by side in a left-right direction and jointly positioned in the accommodating hole.

2. The electrical connector according to claim 1, wherein a wall of the accommodating hole is plated with a conductive member thereon, and the conductive member is in contact with the upper extending portion and the lower extending portion.

3. The electrical connector according to claim 2, wherein the conductive member is in contact with the upper base and the lower base.

4. The electrical connector according to claim 1, wherein:

the upper connecting member comprises an upper strip connecting portion to be connected to the first strip, the upper extending portion is formed by extending from one side below the upper strip connecting portion, the upper extending portion comprises a first section, a second section and a third section sequentially downward from top thereof, and the second section protrudes toward a direction away from the lower extending portion in the left-right direction relative to the first section and the third section; and the lower connecting member comprises a lower strip connecting portion to be connected to the second strip, the lower extending portion is formed by extending from one side above the lower strip connecting portion, the lower extending portion comprises a fourth section, a fifth section and a sixth section sequentially upward from bottom thereof, and the fifth section protrudes toward a direction away from the upper extending portion in the left-right direction relative to the fourth section and the sixth section.

5. The electrical connector according to claim 4, wherein the third section is in contact with the lower strip connecting portion and the fourth section, and the sixth section is in contact with the upper strip connecting portion and the first section.

6. The electrical connector according to claim 5, wherein in the left-right direction, a width of the upper strip connecting portion is equal to a sum of a width of the sixth section and a width of the first section, and a width of the lower strip connecting portion is equal to a sum of a width of the third section and a width of the fourth section.

7. The electrical connector according to claim 1, wherein the upper connecting member and the lower connecting member surroundingly form a first through hole, and the upper extending portion and the lower extending portion are located at a left side and a right side of the first through hole.

8. The electrical connector according to claim 7, wherein the upper base and the lower base are in contact with each other and surroundingly form a second through hole, and the second through hole is in communication with the first through hole in the front-rear direction.

9. The electrical connector according to claim 8, wherein an area of the first through hole is greater than an area of the second through hole.

10. The electrical connector according to claim 8, wherein:

the upper base has two upper branches located at two sides of the second through hole, one of the two upper branches fixes the upper extending portion, and the other of the two upper branches is in contact with the lower extending portion; and the lower base has two lower branches located at two sides of the second through hole, one of the two lower branches fixes the lower extending portion, and the other of the two lower branches is in contact with the upper extending portion.

11. The electrical connector according to claim 10, wherein the two upper branches are correspondingly aligned and in contact with the two lower branches in a vertical direction.

12. An electrical connector, comprising:

a body, having an accommodating hole running vertically therethrough; and a conductive terminal, accommodated in the accommodating hole, and comprising:

an upper terminal, having an upper base and an upper elastic arm formed by extending from the upper base, wherein the upper elastic arm has an upper contact portion configured to be connected to a first electronic component;

an upper connecting member, fixed on the upper base in a front-rear direction to be connected to a first strip;

a lower terminal, electrically connected with the upper terminal and comprising a lower base and a lower elastic arm extending from the lower base, wherein the lower elastic arm has a lower contact portion configured to be connected to a second electronic component; and a lower connecting member, fixed on the lower base in the front-rear direction to be connected to a second strip, wherein the upper terminal, the lower terminal, the upper connecting member and the lower connecting member are formed separately, the upper connecting member or the upper base has an upper extending portion extending downward, the lower connecting member or the lower base has a lower extending portion extending upward, and the upper extending portion and the lower extending portion are provided side by side and jointly positioned in the accommodating hole.

13. The electrical connector according to claim 12, wherein the upper connecting member and the lower connecting member surroundingly form a first through hole, the upper base and the lower base are in contact with each other and surroundingly form a second through hole, and the second through hole is in communication with the first through hole in the front-rear direction.

14. The electrical connector according to claim 12, wherein in a left-right direction, a maximum distance between outer side edges of the upper extending portion and the lower extending portion away from each other is greater than a width of a remaining portion of the conductive terminal.

15. The electrical connector according to claim 12, wherein the upper extending portion abuts the lower connecting member, and the lower extending portion abuts the upper connecting member.

16. The electrical connector according to claim 12, wherein the upper extending portion abuts the lower base in the front-rear direction, and the lower extending portion abuts the upper base in the front-rear direction.

17. The electrical connector according to claim 12, wherein a wall of the accommodating hole is plated with a conductive member thereon, and the conductive member is in contact with the upper extending portion and the lower extending portion.

18. The electrical connector according to claim 17, wherein the conductive member is in contact with the upper base and the lower base.

19. An electrical connector, comprising:

a body, having an accommodating hole running vertically therethrough;

an upper terminal, comprising an upper base and an upper elastic arm formed by extending from the upper base, wherein the upper elastic arm has an upper contact portion configured to be connected to a first electronic component, and the upper contact portion is located in front of the upper base;

an upper connecting member, fixed on the upper base in a front-rear direction to be connected to a first strip, wherein the upper terminal and the upper connecting member are formed separately;

a lower terminal, comprising a lower base and a lower elastic arm extending from the lower base, wherein the lower elastic arm has a lower contact portion configured to be connected to a second electronic component and the lower contact portion is located in front of the lower base;

a lower connecting member, fixed on the lower base in the front-rear direction to be connected to a second strip, wherein the lower terminal and the lower connecting member are formed separately; and a conductive member, accommodated in the accommodating hole, wherein at least one of the upper terminal and the upper connecting member is in contact with the conductive member, and at least one of the lower terminal and the lower connecting member is in contact with the conductive member.

20. The electrical connector according to claim 19, wherein the upper contact portion and the lower contact portion are aligned vertically.

* * * * *